United States Patent [19]

Heinz et al.

[11] Patent Number: 4,711,432

[45] Date of Patent: Dec. 8, 1987

[54] GAS WASHING DEVICE

[75] Inventors: Michael Heinz, Saarbrücken; Joachim Lange, Hünstetten; Udo Muschner, Tönisvorst; Herbert Naefe; Hans Rothfuss, both of Wiesbaden; Manfred Winkelmann; Hans-Joachim Winkler, both of Krefeld, all of Fed. Rep. of Germany

[73] Assignee: Didier-Werke AG, Wiesbaden, Fed. Rep. of Germany

[21] Appl. No.: 877,971

[22] Filed: Jun. 23, 1986

[30] Foreign Application Priority Data

Jun. 28, 1985 [DE] Fed. Rep. of Germany ..... 3523171

[51] Int. Cl.[4] ..... C21C 5/48

[52] U.S. Cl. ..... 266/220; 266/270

[58] Field of Search ..... 266/220, 270, 265

[56] References Cited

U.S. PATENT DOCUMENTS

| | | | |
|---|---|---|---|
| 2,811,346 | 10/1957 | Spire | 266/220 |
| 3,330,645 | 7/1967 | De Moustier et al. | 75/59.28 |
| 3,971,548 | 7/1976 | Folgerö et al. | 266/218 |
| 4,331,471 | 5/1982 | Langenfeld et al. | 266/217 |
| 4,539,043 | 9/1985 | Miyawaki et al. | 266/265 |

FOREIGN PATENT DOCUMENTS

| | | | |
|---|---|---|---|
| 1608036 | 12/1970 | Fed. Rep. of Germany . | |
| 3240097 | 5/1984 | Fed. Rep. of Germany . | |
| 1555947 | 1/1969 | France | 266/220 |
| 38321 | 3/1984 | Japan | 266/220 |
| 17804 | 5/1984 | Japan | 266/220 |

OTHER PUBLICATIONS

Radex-Rundschau, Heft 3, 1983, S. 179-209, "Einsatz und Verschleiss von Spülsteinen in der Sekundärmetallurgie", Grabner et al.

*Primary Examiner*—L. Dewayne Rutledge
*Assistant Examiner*—Robert L. McDowell
*Attorney, Agent, or Firm*—Wenderoth, Lind & Ponack

[57] ABSTRACT

A gas washing device includes a permeable gas sink, a gas inlet for supplying gas through the sink to a molten metal container, a gas flow meter positioned upstream of the gas inlet, and a further gas sink having a gas permeability greater than that of the first-mentioned gas sink and positioned between the gas inlet and the first-mentioned gas sink.

3 Claims, 1 Drawing Figure

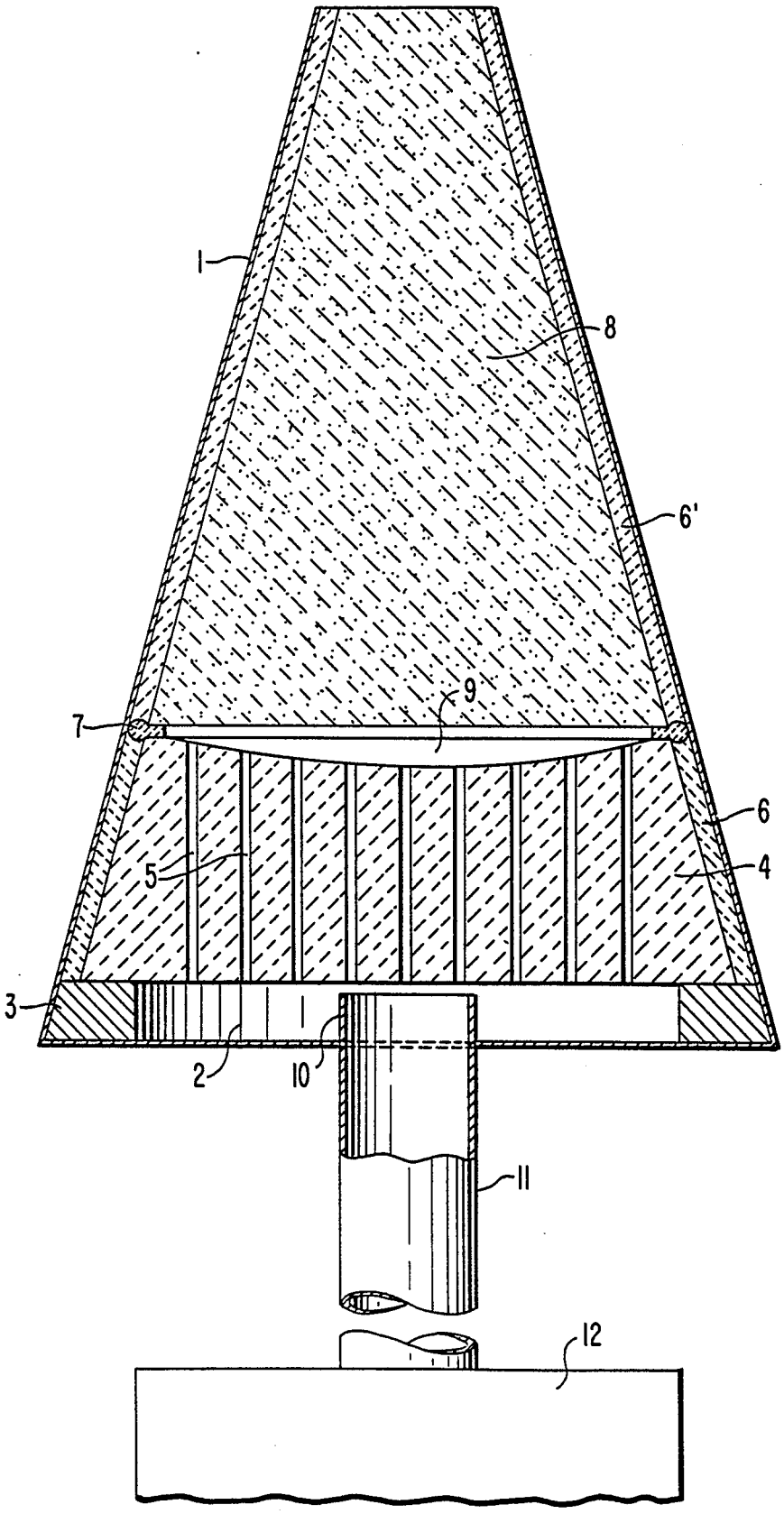
1
8
6'
9
7
6
5
4
3
2
10
11
12

GAS WASHING DEVICE

BACKGROUND OF THE INVENTION

The present invention relates to a gas washing device of the type including a permeable gas sink, a gas inlet for supplying gas through the sink to a molten metal container, a layer of gas permeable material located between the sink and the gas inlet, and a gas flow meter upstream of the gas inlet.

This general type of gas washing device is disclosed in the journal "Giesserei 72", 1985, No. 6. The layer of gas permeable material on which the gas sink rests is formed by loose, coarse, monolithic lining material. When the material of the gas sink all is used, then the molten metal passes into such layer, and this avoids a breakthrough of the molten metal upon consumption of the gas sink.

DE-OS No. 32 40 097 also discloses a layer of granular fill material. This fill material has a melting point below the temperature of the molten metal. This has the effect that when the gas sink is consumed and molten metal passes into the fill material, a closure is formed which prevents molten metal from breaking through. This arrangement however also interrupts the gas washing operation.

EP No. 0 082 078 A1 discloses a gas sink including electrodes to provide an electric monitoring of the extent of wear of the gas sink.

SUMMARY OF THE INVENTION

The object of the present invention is to provide such a gas washing device but whereby it is possible to detect wear of the gas sink in a timely manner without the need for employing a gas sink having electrodes.

This object is achieved in accordance with the present invention by the provision that the layer of gas permeable material between the gas sink and the gas inlet is in the form of a further gas sink having a gas permeability greater than that of the first-mentioned gas sink. Thus, if the first-mentioned gas sink is consumed, then the flow through the device will be greater due to the greater gas permeability of the further gas sink, and this will be detected immediately by the flow meter. The gas washing operation does not have to be interrupted immediately after the first-mentioned gas sink is used up, because the other gas sink continues to maintain the gas flow and perform gas washing. The first gas sink may be renewed or replaced at the first convenient opportunity.

In accordance with a preferred feature of the present invention, the further gas sink is a sieve washer or capillary washer having therethrough a plurality of vertical gas passages and the gas permeability of which is considerably higher than that of the first gas sink.

BRIEF DESCRIPTION OF THE DRAWING

Other objects, features and advantages of the present invention will be apparent from the following detailed description, taken with the accompanying drawing, wherein:

The single FIGURE is a schematic cross sectional view of a gas washing device according to the present invention.

DETAILED DESCRIPTION OF THE INVENTION

The gas washing device includes a metal, for example steel or sheet metal, jacket 1 having a generally upwardly converging tapered or conical configuration. A permeable gas sink 8 is positioned in the upper portion of jacket 1 and may be sealed thereto by a mortar layer 6'. A gas inlet 10 of a gas line 11 extends into a gas distribution chamber 2 at the bottom of casing 1 so that gas to be washed is supplied upwardly through permeable gas sink 8 and then may be supplied to molten metal contained within a metallurgical vessel. The constructions and manner of operation of this general type of arrangement and device is known in the art, and further discussion thereof therefore will not be necessary.

Located beneath permeable gas sink 8 is a layer of gas permeable material which in accordance with the improvement of the present invention is in the form of a further gas sink 4 having a greater gas permeability than gas sink 8. In a preferred arrangement of the present invention, further gas sink 4 is in the form of a sieve washer (capillary washer) having extending therethrough a plurality of vertical gas passages 5 providing a greater degree of gas permeability than the gas sink 8. Sieve washer 4 rests on a spacer ring 3 setting on the bottom of jacket 1 and helping to define gas distribution chamber 2. Sieve washer 4 may be sealed in jacket 1 by mortar layer 6. Between the gas sink 4 and the sieve washer 4 is a gas distribution area 9 which may be formed by a concave, somewhat spherical recess formed in the top of sieve washer 4. A gas flow meter is connected to gas line 11 upstream of gas inlet 10. A sealing ring 7 is positioned between gas sink 8 and sieve washer 4 and seals against the interior of jacket 1.

The gas washing device described above operates in the following manner.

As long as permeable gas sink 8 is not consumed or used up, a particular gas flow will be maintainec through the device, and this gas flow will be determined by the permeability of gas sink 8. The gas flow will be through gas line 11, inlet 10, chamber 2, gas passages 5, gas distribution area 9, and gas sink 8 into a metallurgical vessel containing a molten metal.

If the gas sink 8 is used up or consumed, then the amount of flow will suddenly increase dramatically, since the amount of flow now is limited by sieve washer 4, which has a considerable higher gas permeability than gas sink 8. This immediate rise of the amount of gas flow will be detected by flow meter 12, and this will provide an indication that permeable gas sink 8 is used up and must be replaced at the first convenient opportunity. However, such replacement need not occur immediately, and the device does not have to be shut down immediately, since sieve washer still will permit operation of the gas washing device for a certain period of time.

It is intended that the various elements of the gas washing device of the present invention be constructed of materials which are customary in the art. The gas sinks may be formed of materials based on aluminum oxide or magnesium oxide. Spacing ring 4 may be formed of steel. Sealing ring 7 may be in the form of a cord formed of ceramic fibers. It of course is intended that other materials as will be apparent to those skilled in the art may be employed.

Although the present invention has been described and illustrated with respect to preferred features thereof, it is to be understood that various modifications and changes may be made to the specifically described and illustrated features without departing from the scope of the present invention.

We claim:

1. A gas washing device for supplying gas through a metallurgical vessel to molten metal therein, said device comprising:

a metal jacket to be positioned to extend through a wall of a metallurgical vessel;

an inner permeable gas sink positioned within said jacket and having an inner surface to contact molten metal within the metallurgical vessel;

an outer permeable gas sink positioned within said jacket at a position outwardly of said inner gas sink and to be spaced from the molten metal;

gas inlet means for supplying gas from a gas supply to said jacket such that said gas flows first through said outer gas sink and then through said inner gas sink into the molten metal;

sealing ring means positioned between said outer and inner gas sinks and sealing against said jacket for preventing leakage of said gas between said gas sinks;

gas distribution means formed between an inner end of said outer gas sink and an outer end of said inner gas sink for ensuring that gas immerging from said inner end of said outer gas sink is supplied uniformly over substantially the entire area of said oter end of said inner gas sink; and means for detecting immediately consumption of said inner gas sink by the molten metal without interrupting the supply of gas thereto, said detecting means comprising said outer gas sink having a gas permeability greater than that of said inner gas sink such that upon consumption of said inner gas sink the flow of said gas wiil increase abruptly, and gas flow meter means connected to said gas supply at a position upstream of said gas inlet means for detecting said abrupt increase of gas flow.

2. A device as claimed in claim 1, wherein said outer gas sink comprises a sieve washer having therethrough gas passages.

3. A device as claimed in claim 1, wherein said gas distribution means comprises a concave recess formed in said inner end of said outer gas sink.

* * * * *